US009193143B2

(12) United States Patent
Choi et al.

(10) Patent No.: US 9,193,143 B2
(45) Date of Patent: Nov. 24, 2015

(54) PRECISION OVERPRINTING METHOD OF PRINTED ELECTRONICS ROTARY PRINTING WHERE LOCATION CAN BE ADJUSTED IN REAL TIME

(71) Applicant: KOREA INSTITUTE OF MACHINERY & MATERIALS, Daejeon (KR)

(72) Inventors: Byung-Oh Choi, Daejeon (KR); Byung-Soon Ryoo, Daejeon (KR); Kyu Jin Lim, Daejeon (KR); Dong-Soo Kim, Daejeon (KR); Jeong Dai Jo, Daejeon (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 132 days.

(21) Appl. No.: 13/627,523

(22) Filed: Sep. 26, 2012

(65) Prior Publication Data

US 2014/0083316 A1 Mar. 27, 2014

(51) Int. Cl.

| | |
|---|---|
| ***B41F 13/14*** | (2006.01) |
| ***B41J 29/38*** | (2006.01) |
| ***B41F 33/00*** | (2006.01) |
| ***B41F 9/01*** | (2006.01) |

(52) U.S. Cl.

CPC . *B41F 13/14* (2013.01); *B41F 9/01* (2013.01); *B41F 33/0081* (2013.01)

(58) Field of Classification Search

CPC ..... B41F 13/025; B41F 13/14; B41F 13/12

USPC ..... 101/485, 486, 481, 484, 490, 248

See application file for complete search history.

(56) References Cited

U.S. PATENT DOCUMENTS

| | | | | |
|---|---|---|---|---|
| 4,932,320 | A * | 6/1990 | Brunetti et al. | 101/181 |
| 5,649,484 | A * | 7/1997 | Broghammer et al. | 101/248 |
| 6,626,104 | B2 * | 9/2003 | Albus et al. | 101/248 |
| 2004/0118311 | A1 * | 6/2004 | Tokiwa | 101/485 |
| 2008/0290647 | A1 * | 11/2008 | Adamczyk et al. | 283/72 |
| 2009/0275157 | A1 * | 11/2009 | Winberg et al. | 438/29 |
| 2009/0288567 | A1 * | 11/2009 | Choi et al. | 101/154 |

FOREIGN PATENT DOCUMENTS

| | | | | |
|---|---|---|---|---|
| JP | 07-304162 | | 11/1995 | |
| JP | 08052861 | A * | 2/1996 | B41F 33/14 |
| JP | 2000225689 | A * | 8/2000 | B41F 33/14 |
| JP | 2002192702 | A * | 7/2002 | B41F 33/14 |
| JP | 2004-188684 | | 7/2004 | |

(Continued)

*Primary Examiner* — Matthew G Marini
*Assistant Examiner* — Ruben Parco, Jr.
(74) *Attorney, Agent, or Firm* — Lex IP Meister, PLLC

(57) ABSTRACT

The present invention relates to a precision overprinting method of printed electronics rotary printing where a location can be adjusted in real time. More particularly, minute precise printing electronic patterns of a micrometer level which are multilayered by a plurality of gravure offset printing units are accurately overprinted, and a fine deviation in a rotation direction and an axial direction of a plate cylinder is quickly solved. The present invention also relates to a precision overprinting method of printed electronics rotary printing where a location can be adjusted in real time, capable of verifying a printing quality by displaying register marks printed in printing units and alignment state on a display device.

5 Claims, 5 Drawing Sheets

(56) References Cited

FOREIGN PATENT DOCUMENTS

| | | |
|---|---|---|
| JP | 2007-015214 | 1/2007 |
| JP | 2007-137053 | 6/2007 |
| KR | 10-2005-0001470 | 1/2005 |
| KR | 10-0634327 | 10/2006 |
| KR | 10-2010-0135685 | 12/2010 |
| KR | 10-2011-0008673 | 1/2011 |
| KR | 10-1071630 | 10/2011 |

* cited by examiner

PRECISION OVERPRINTING METHOD OF PRINTED ELECTRONICS ROTARY PRINTING WHERE LOCATION CAN BE ADJUSTED IN REAL TIME

BACKGROUND OF THE INVENTION (a) Field of the Invention

The present invention relates to a technology of accurately aligning various functional circuit layers with printing units to perform precision overprinting when simple electronic elements such as resistors and electrode circuits are precisely overprinted in the same pattern to be printed or a micrometer size electronic printing product where electronic circuits such as accumulators, diodes, transistors, and integrated circuits are multilayered is overprinted by a gravure offset rotary printer including a plurality of gravure offset rotary printing units.

(b) Description of the Related Art

The technology associated with the present invention is based on 'a method and an apparatus for manufacturing an electronic element using a roll-to-roll rotary printing method' filed by the applicant (Korean Application No. 10-2005-30722) and registered on Oct. 9, 2006 (Korean Patent No. 10-0634327).

In the registered patent, as illustrated in FIG. 3 of the present invention, a roll-to-roll rotary printing system for printing and manufacturing an electronic device having a multilayered functional ink layer structure by using a plurality of gravure offset printing units on one roll-to-roll rotary printer.

Such a roll-to-roll rotary printing printer employs a plurality of gravure offset type printing units which are not adopted in an in-line structure multicolor image printing. The printing units use a high resolution and a wide range of ink amount forming regulating capacity which are advantages of engravings in a gravure printing method and utilize a flexibility of a rubber itself and unique ink transfer characteristics on a surface of a rubber in a pad printing method, and thus are in charge of constituent circuit patterns of a three-dimensional electronic circuit element, respectively, to perform overprinting without destroying preceding ink layers. As a result, an electronic element can be collectively overprinted in one printer.

In general, in an alignment technology of realizing overprinting with a plurality of rotary printing units, one register mark is designated for each circumference of plate cylinder corresponding to the printing unit, respectively, and location of the register mark is verified per one rotation to correct location errors of the plate cylinders. An existing correcting method where a compensating roller is installed between printing units tends to develop to a sectional method as a plate cylinder recently starts to be driven in a direct drive method utilizing a servo motor. In any correction method, a traditional correction method of one rotation-one register mark is used. That is, one register mark is sufficient for alignment to a circumference of one plate cylinder. The correction method may be sufficient in image printing pursuing high-speed printing, but its precision is considerably insufficient in roll-to-roll rotary printing of an electronic element requiring a micrometer unit precision overprinting.

The reason why an overprinting precision in the one rotation-one register mark method is insufficient is that a location and a size of a printing line is changed in a micrometer level due to expansion and contraction of a film caused by various stress changes, such as printing pressure, dry heating, tension, and friction, which are inevitably applied while a thin roll printing film passes a plurality of printing units. Thus, in the one register mark per rotation method, an accurate arrangement is difficult even when complex prediction calculations and methods are utilized.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to solve a problem which is basically difficult to be applied in printing of a minute electronic device pattern because in the related art, printing pressures in nip of printing cylinders which a printing film undergoes in printing utilizing a roll-to-roll printing system including a plurality of gravure offset printing units, friction and tensile forces applied when rollers pass through gaps between adjacent printing units, and changes of thickness, width, and length of the printing film caused by a caused by a change in tensile force due to stress generated while a printing paper undergoes a change in temperature and humidity from a drying unit installed in the gap are to be solved at one time.

The other objects and advantages of the present invention will be described below, and will be recognized by the embodiment of the present invention.

Further, the objects and advantages of the present invention can be realized by the means and combination of the claims.

An exemplary embodiment of the present invention provides a precision overprinting method of printed electronics rotary printing in which a location can be adjusted in real time, for overprinting an electronic circuit pattern P by using a roll-to-roll rotary printing system including a plurality of gravure offset printing units 100, including: a mark displaying step S100 of printing a plurality of register marks M on a printing paper 1 through printing devices 10 of the printing units 100, and printing the register marks M having different shapes with the printing units 100, respectively; a mark photographing step S200 of photographing the register marks M printed on the printing paper 1 by the printing units 100 through a camera device 20; a mark location measuring step S300 of receiving register mark M image information of the camera device 20 through a vision control system 30 to verify the image information with a display device 40, and comparing a location coordinate of the photographed register mark M with a location coordinate previously designated by a user to calculate a deviation; and an overprinting correcting step S400 of receiving a correction signal from the vision control system 30, and adjusting a location of a plate cylinder 11 of the corresponding printing unit 100 where a deviation of a register mark M is generated to align the overprinting of the electronic circuit pattern.

The mark displaying step S100 is performed by a gravure offset printing device 10 including: a plate cylinder 11 where register marks M having the same shape are spaced apart from each other at a predetermined interval D at a circumference of an outer peripheral surface of an end thereof; a blanket cylinder 14 to which the electronic circuit pattern P and the register mark M of the plate cylinder 11 is printed and transferred as the blanket cylinder 14 is rotated at the same printing speed as that of the plate cylinder 11 while contacting the plate cylinder 11; and a pressing cylinder 17 configured to print and transfer the electronic circuit pattern P and the register mark M to the printing paper 1 as the pressing cylinder 17 is rotated while contacting the blanket cylinder 14 via the printing paper 1.

A location of the plate cylinder 11 is adjusted a plurality of times in a rotation direction or an axial direction in one rotation toward the blanket cylinder 14 rotating while contacting the plate cylinder 11, by a driving part 50 having received the correction signal of the vision control system 30.

The predetermined interval D is an interval at which the register marks M are spaced apart from each other such that the register marks M at the front and rear ends which are adjacent to a photographing screen 3 of the cameral device 20 are not simultaneously photographed when the marks are photographed.

Register marks M formed in the plate cylinder 11 of a first printing unit #1 of the plurality of printing units 100 become a reference register mark α of the remaining printing units 100, register marks M of the remaining printing units 100 are spaced apart in a transverse or longitudinal direction of the reference register mark α in the printing paper 1 to be printed, and the register marks M of the plurality of printing units 100 are printed at predetermined locations where the register marks M of the plurality of printing units 100 are against each other not to overlap each other.

The register marks M printed through the plurality of printing units 100 have different shapes to be easily identified from each other, and are displayed in one shape of '⌐', '¬', 'ㄴ', and 'ㄴ'.

When a mutual location between the reference register mark α of the first printing unit #1 and the register marks M of the remaining printing units 100 is determined, while taking a center point coordinate of an imaginary line connecting opposite ends of the register marks as a reference location coordinate S, an error of a mutual distance l and m between the reference location coordinates S is calculated to correct a location of the plate cylinder 11.

The vision control system 30 calculates a location deviation of the register mark M photographed by the camera devices 20 of the printing units 100 before the next register mark M is read and adjusts a location of the plate cylinder 11 while a printing interval D of the plurality of register marks printed on the printing paper 1 is allowed.

The camera device 20 is a still image device capable of recognizing an image of a micrometer size and displaying a visual quality of the printing image with the display device 40, and includes: high precision CCD or CMOS area camera sensor 21; a camera lens 22 configured to compensate a pixel size of the camera sensor 21 to obtain a precise image; and a lamp 23 configured to provide a light amount for a clear image. According to the exemplary embodiments of the present invention, precise overprinting having a minute electronic circuit pattern requiring a several micrometer level is allowed by further develop an alignment method for electronic gravure offset rotary printing according to a basis patent, newly changing the method to a one rotation-a plurality of register mark method by using different register marks and alignment methods which can be easily identified by a camera, and overcoming an alignment limit in a several tens of micrometer level according to existing printing by using one register mark in one rotation of a plate cylinder to realize a higher alignment precision through a fine shift adjustment.

DETAILED DESCRIPTION OF THE EMBODIMENTS

Figure 1:
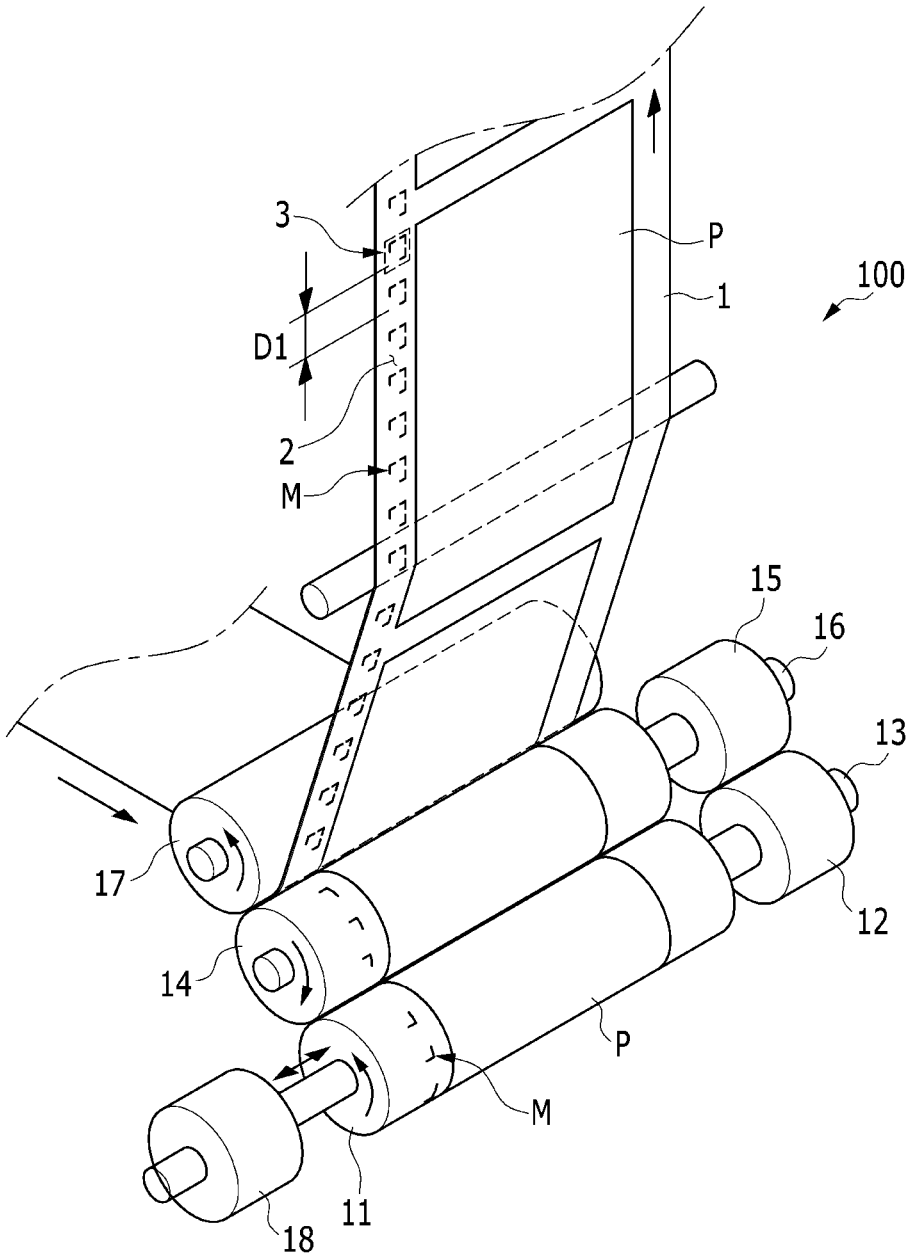
FIG. 1 is a perspective view of an exemplary embodiment illustrating a driving device of a printing unit and a printing state diagram according to the present invention.

Before describing various exemplary embodiments of the present invention in detail, it can be seen that applications thereof are not limited to details of configurations and arrangements of constituent elements which are described in the following detailed description or illustrated in the drawings. The present invention may be realized and carried out by other embodiments, and may be performed in various methods. Further, it can be seen that expressions and wordings used herein regarding such terms as directions (for example, "front", "back", "up", "down", "top", "bottom", "left", "right", and "lateral") of devices or elements are used only to simplify the description of the present invention and do not represent or mean that the related devices or element needs to have specific directions simply. In addition, terms such as "first" and "second" are used in the specification and the accompanying drawings for description, and are not intended to represent or mean relative importance or purport.

The present invention has the flowing features to achieve the above object.

Hereinafter, exemplary embodiments of the present invention will be described in detail with reference to the accompanying drawings. Prior to the description, the terms and wordings used in the specification and the claims should not be construed to be limited to general and lexical meanings and should be construed as meanings and concepts corresponding with the technical spirit of the present invention based on a principle that the inventor can suitably define the concepts of the terms to describe his or her invention in the best way.

Thus, the exemplary embodiments described in the specification and the configurations illustrated in the drawings are simply the most preferable embodiments of the present invention and are not representative of all the technical spirits of the present invention, and thus it should be understood that various equivalents and modified examples which can replace them are present at the time when the present invention is filed.

Hereinafter, a precision overprinting method of printed electronics rotary printing where a location can be adjusted in real time according to an exemplary embodiment of the present invention will be described with reference to FIGS. 1 to 5.

A precision overprinting method of printed electronics rotary printing in which a location can be adjusted in real time, for overprinting an electronic circuit pattern P by using a roll-to-roll rotary printing system including a plurality of gravure offset printing units 100 according to the present invention, includes: a mark displaying step S100 of printing a plurality of register marks M on a printing paper 1 through printing devices 10 of the printing units 100, and printing the register marks M having different shapes with the printing units 100, respectively; a mark photographing step S200 of photographing the register marks M printed on the printing paper 1 by the printing units 100 through a camera device 20; a mark location measuring step S300 of receiving register mark M image information of the camera device 20 through a vision control system 30 to verify the image information with a display device 40, and comparing a location coordinate of the photographed register mark M with a location coordinate previously designated by a user to calculate a deviation; and an overprinting correcting step S400 of receiving a correction signal from the vision control system 30, and adjusting a location of a plate cylinder 11 of the corresponding printing unit 100 where a deviation of a register mark M is generated to align the overprinting of the electronic circuit pattern.

1. In the mark displaying step S100, a plurality of register marks M having the same shape is engraved at circumferences of the plate cylinders 11 such that the plurality of register marks M is displayed on a printing paper 1 through the printing devices 10 of the printing units (gravure offset printing units 100), and register marks M having different shapes are displayed for the printing units 100 (hereinafter, the first printing unit is denoted by #1, the second printing unit is denoted by #2, the third printing unit is denoted by #3, and the fourth printing unit is denoted by #4 for convenience' sake).

As illustrated in FIG. 1, in the printing device 10, the gravure offset printing unit includes a plate cylinder 11, a blanket cylinder 14, and a pressing cylinder 17 having all cylindrical shape.

In the plate cylinder 11, an electronic circuit pattern to be printed is formed at a circumference of an outer peripheral surface thereof, and a plurality of register marks M to be described below is formed in the same shape and at the same interval on an outer peripheral surface of one end of the plate cylinder 11 where the electronic circuit pattern is formed. Further, a servo motor 12 and an encoder 13 are installed at one end of the plate cylinder 11 to rotate the plate cylinder 11. In addition, unlike the blanket cylinder 14 and the pressing cylinder 17, a rotation position of the plate cylinder 11 is minutely adjusted in an axial direction (leftward and rightward) a servo motor 18 through a signal of the vision control system 30 to be described below or in a rotation direction (forward and rearward) of the plate cylinder 11 through a servo motor 12. The details will be described in detail hereinbelow.

An outer peripheral surface of the blanket cylinder 14 is formed of a resilient rubber material, and is correspondingly installed to contact a front end of the plate cylinder 11 lengthwise, such that the ink stuck to the electronic circuit pattern and the register marks formed at a circumference of the outer peripheral surface of the plate cylinder 11 is printed and transferred to the outer peripheral surface of the blanket cylinder while rotating to contact the entire length of the plate cylinder 11. A servo motor 15 and an encoder 16 (which performs the same operations as those of the servo motor 12 and the encoder 13 installed in the place cylinder 11) driven under the control of a synchronous electronic gear are installed at one end of the blanket cylinder 14) to rotate the blanket cylinder 14 at the same speed as that of the plate cylinder 11.

The pressing cylinder 17 is attached to an entire length of the blanket cylinder 14 at a rear end thereof via the printing paper 1 to be rotated, and the pressing cylinder 17 is rotated through friction with the printing paper 1 attached to the blanket cylinder 14. Due to this, the ink of the electronic circuit pattern P and the register marks M printed and transferred to the blanket cylinder 14 is finally printed and transferred to the printing paper 1.

Further, in the present invention, the servo motor 12 and the encoder 13 installed at one side of the plate cylinder 11 regulates a rotation angle of the plate cylinder 11 (an error in a rotation direction is instantaneously shifted if a location adjusting instruction is received) according to a location signal of the vision control system 30 to be described below and minutely adjust a printing location in the rotation direction to minutely adjust the locations of the register marks forward and rearward, and the servo motor 18 installed at an opposite side of the plate cylinder 11 quickly minutely adjusts a location of the plate cylinder 11 in an axial direction (leftward and rightward) according to a location signal of the vision control system 30 to be described below to minutely adjust locations of the register marks in an axial direction.

As illustrated in FIG. 1, while the printing paper 1 passes between the blanket cylinder 14 and the pressing cylinder 17, the electronic circuit pattern and the register mark formed in the first plate cylinder 11 are printed on one surface thereof by the blanket cylinder 14.

As illustrated in FIG. 1, a printed circuit pattern is printed on one surface of the printing paper 1 at a predetermined interval D1, and a register mark M is printed on a white margin 2 where the printed circuit pattern is not printed, that is, on one of the opposite sides of the printed circuit pattern. Of course, it may be printed at a spaced portion between the printed circuit pattern P according to an embodiment of the user.

As illustrated in FIGS. 5A to 5D, the register mark M is a line component whose center is bent, and has one shape of the four forms such as '⌐', '¬', '⌋', and '⊔' one side of which is parallel to an axis of the plate cylinder 11 and an opposite side of which is perpendicular to the axis of the plate cylinder 11 (a component width of the register mark may be not more than a width of the printing electronic circuit pattern to be utilized for estimation of printing quality). When four gravure offset printing units 100 are used as in the present invention, a register mark having a '⌐' shape is engraved in the plate cylinder 11 of the first printing unit #1, a register mark having a '¬' shape is engraved in the plate cylinder 11 of the second printing unit #2, a register mark having a '⌋' shape is engraved in the plate cylinder 11 of the third printing unit #3, and a register mark having a '⊔' shape is engraved in the plate cylinder 11 of the fourth printing unit #4, such that the register marks engaged in the printing units 100 may be printed whenever the printing paper 1 passes through the printing units #1, #2, #3, and #4, in order that it can be easily identified which printing unit 100 through which the printing paper 1 has passed through the printing register mark and a location of the plate cylinder 11 of which printing unit 100 is wrong.

Further, a plurality of register marks are spaced at a predetermined interval along circumferences of ends of outer peripheral surfaces of the plate cylinders 11 of the printing units 100, and for example, if the printing paper 1 passes through the first printing unit #1, a plurality of register marks having a '⌐' shape printed in the first printing unit #1 are printed to be spaced apart from each other in the white margin 2 of the printing paper 1. In this case, the predetermined interval D1 between a plurality of register marks printed through the first printing unit #1 is set such that the register marks at a front end or a rear end adjacent to the photographing screen 3 (or a screen of the display device 40 showing a photographing screen 3 of the camera device 20) of the camera device 20 are not simultaneously photographed in the register mark photographing step.

Thus, as illustrated in FIG. 1, the fact that all of the register marks having '⌐', '¬', and '⌙' are printed in the printing paper 1 means that the printing paper 1 has passed the third printing unit #3, and thus it can be seen that FIG. 1 also illustrates a drawing regarding the third printing unit #3.

Figure 4:
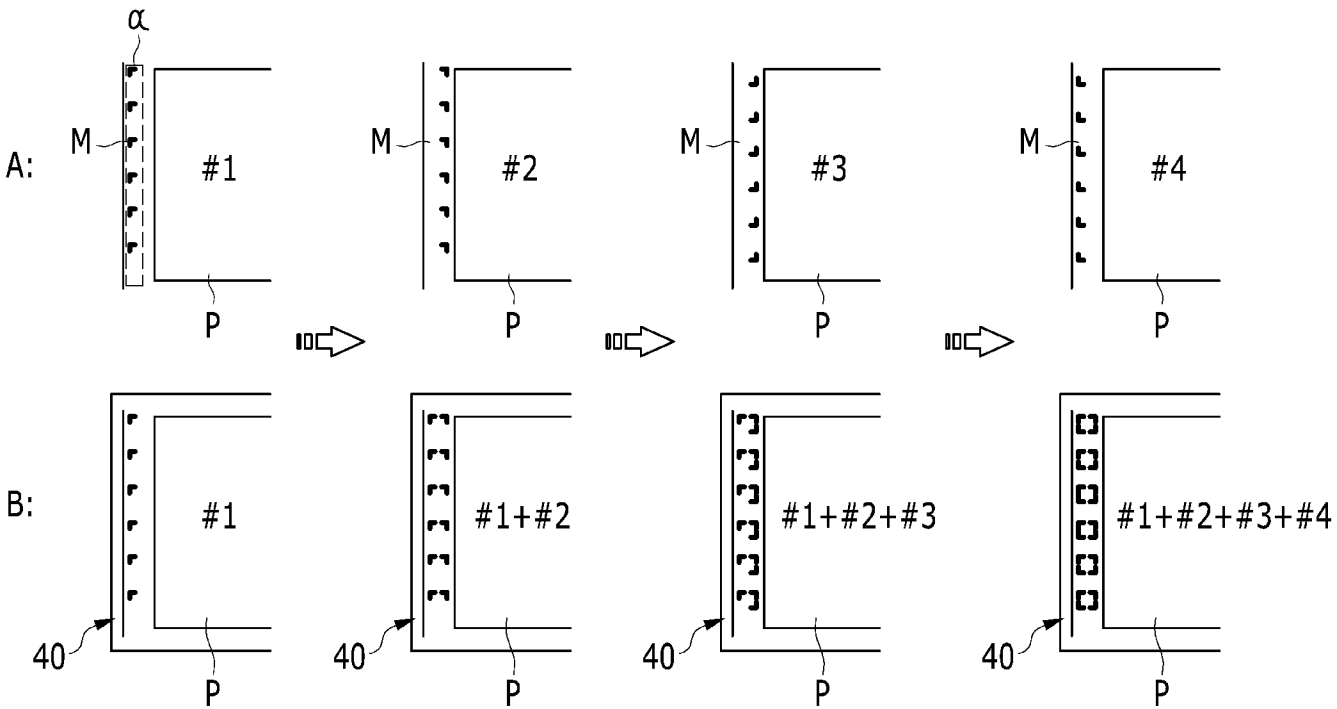
FIG. 4 is a view of an exemplary embodiment illustrating register mark dispositions of plate cylinders and printing results when four printing units according to the present invention are used.

Further, in a description based on the above embodiment, the plurality of register marks '⌐' formed in the plate cylinder 11 of the first printing unit #1 of the plurality of printing units #1, #2, #3, and #4 become the reference register marks a of the remaining printing units #2, #3, and #4, and as illustrated in FIG. 4, the register marks of the remaining printing units #2, #3, and #4 are printed to be spaced part from each other in a transverse or longitudinal direction of the reference register mark α in the printing paper 1. The register marks of the plurality of printing units #1, #2, #3, and #4 are printed at a uniform interval at different locations not to overlap each other.

Figure 5:
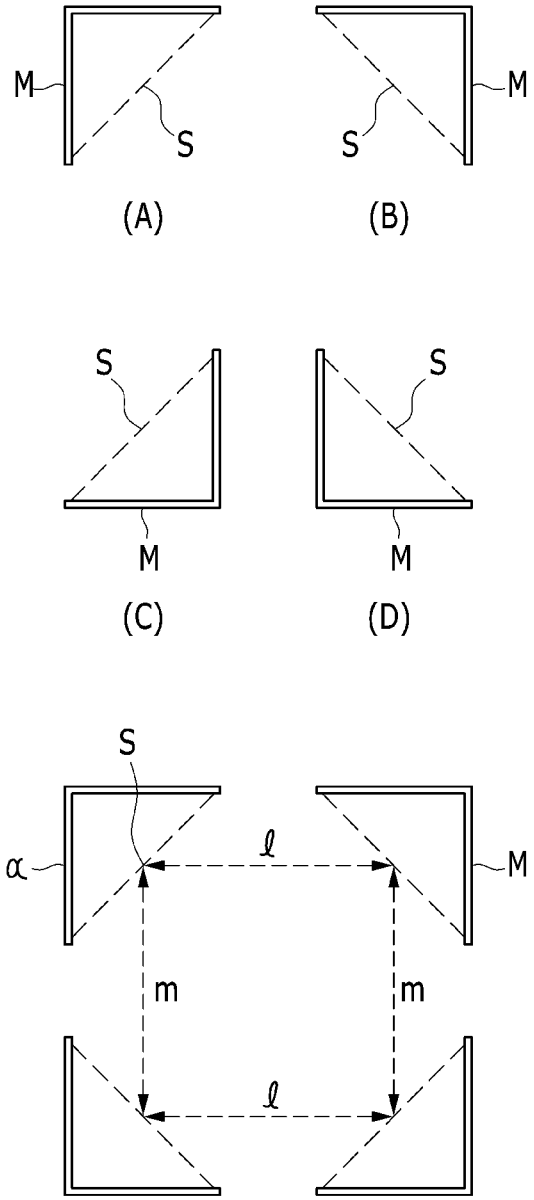
FIG. 5 is a view of an exemplary embodiment illustrating register mark forms and intervals thereof according to the present invention.

In addition, as illustrated in FIG. 5, the locations between the reference register marks a of the first printing unit #1 and the register marks of the remaining printing units are determined by, while taking the center points of imaginary lines connecting opposite ends of the register mark as reference location coordinates S, calculating a distance (l, m) error between the reference location coordinates S and correcting the location of the plate cylinder 11 of the corresponding printing unit where an error is generated by the error.

2. In the mark photographing step S200, the register marks M displayed on the printing paper 1 are photographed for the printing units 100 through the camera device 20.

The camera device 20 is adapted to photograph a register mark of the printing paper 1 having passed through the printing unit 100, and as an exemplary embodiment, by using four printing units 100, when the printing paper 1 passes through the first, second, third, and fourth printing units #1, #2, #3, and #4, the camera device is installed in each of the four printing units #1, #2, #3, and #4 so that the register marks are photographed whenever the printing paper 1 passes through the printing units #1, #2, #3, and #4.

Figure 2:
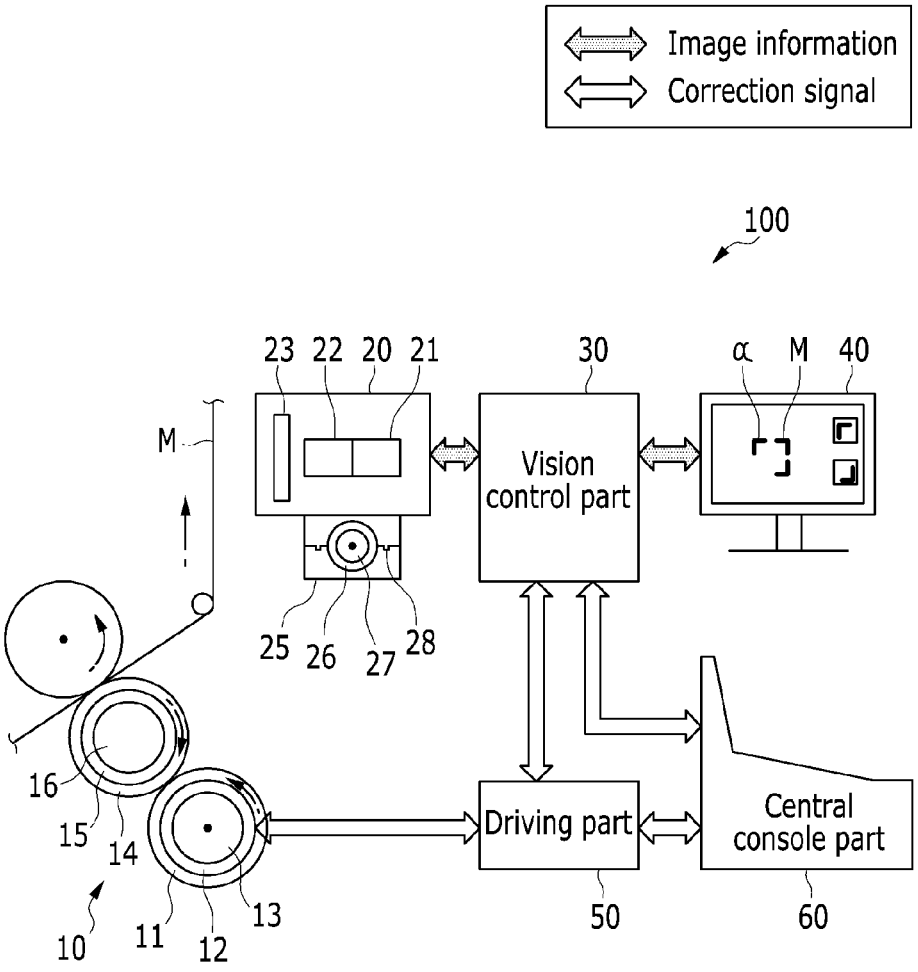
FIG. 2 is a view of an exemplary embodiment illustrating the concept of a system including a single printing unit, a vision control part, a camera device, a driving part, and a central console control part according to the present invention.
Figure 3:
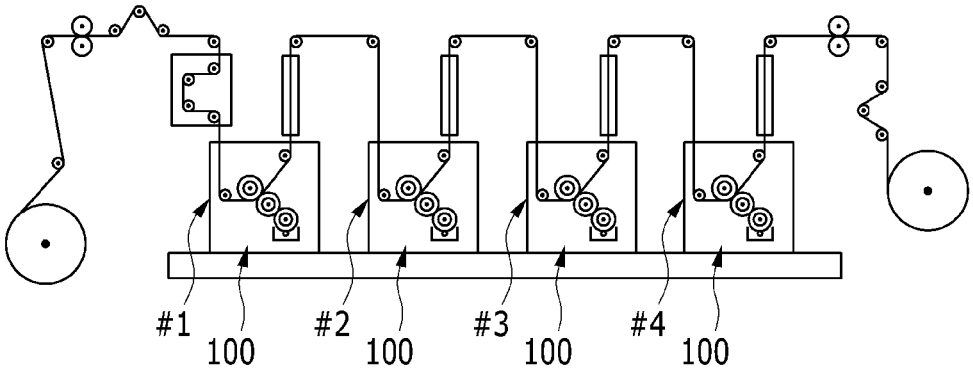
FIG. 3 is a view of an exemplary embodiment illustrating a roll-to-roll rotary printing system including a plurality of gravure offset printing units.

Such a camera device 20 may recognize a micrometer level image and is a still image device capable of representing a quality of a visual printing image with the display device 40. As illustrated in FIG. 2, the camera device 20 is installed at an upper end of each printing unit 100, together with the camera driving device 25 employing a servo motor 26, an encoder 27, and an LM guide 28 to drive the camera device 20, at a location close to a printing pressure portion immediately after the printing, before the printing paper 1 enters the corresponding drying part (not shown).

The camera device 20 includes a high precision charge coupled device (CCD) or complementary metal oxide semiconductor (CMOS) area camera sensor 21, a camera lens 22 for compensating a pixel size of the camera sensor 21 to obtain a precise image, and a lamp 23 for providing a light amount for a clear image.

That is, the camera device 20 is adapted to transmit a photographed screen 3 obtained by photographing one of the plurality of register marks of the printing paper 1 to the display device 40 through the vision control system 30 to be described above, and as illustrated in FIG. 1, only one part (the photographed screen 3 of FIG. 1) of the plurality of register marks is transmitted. When the transmitted reference register mark α and the remaining register marks printed together are of a proper quality, they are registered as a printing screen and are used as an alignment reference.

3. The mark location measuring step S300 is a step of receiving the register mark M image information of the camera device 20 through the vision control system 30, and comparing the location of the photographed register mark M with a location previously designated by a user to calculate a deviation, and in the overprinting correcting step S400, a correction signal for the deviation is transferred from the vision control system 30, and a location of the plate cylinder 11 of the corresponding printing unit 100 where the deviation of the register mark M is generated such that the overprinting of the electronic circuit patterns P printed on the printing paper 1 through the printing units is aligned.

The vision control system 30 is adapted to perform all input/output functions necessary for the image processing, in which the camera device 20 transmits the image information printed in the fastest associated way, the vision control system 30 compares the location coordinate value of the photographed register mark with a coordinate value previously designated by the user to calculate a deviation and transfers a correction signal (a correction signal for adjusting a location of the plate cylinder 11) to the driving part 50 connected to the servo motor 11 of the plate cylinder 11, the driving part 50 having received a correction signal minutely adjusts a rotating angular speed to the encoder 13 of the servo motor 12 to control the rotation and driving of the plate cylinder 11 constituting the printing unit 100. That is, the driving part 50 having received the correction signal from the vision control system 30 minutely adjusts a location of the plate cylinder 11 of the corresponding printing unit 100 where a deviation of the register mark is generated in an axial direction or a rotation direction to align the overprinting of the electronic circuit pattern printed on the printing paper 1. (The present invention includes a central console 60 electrically connected to the vision control system 30 and the driving unit 50, and the central console 60 performs all operation functions and setting functions for an input/output of the operation other than the vision control system 30, the display device, and the input/output function.)

The servo motors 12 and 18 are installed at opposite ends of all the plate cylinders 11 constituting the printing unit 100, and the driving part 50 connected to the servo motor 12 rotates and drives the plate cylinder 11 at a uniform speed through the servo motor 12 of the first printing unit #1 and prints an electronic circuit pattern and a reference register mark on the printing paper first by using a blanket cylinder. Further, the second printing unit #2 rotates and drives the plate cylinder 11 through the servo motor 12, and prints an electronic circuit pattern and a register mark on the printing paper at a location designated from the reference register mark by using a blanket cylinder. In addition, the third printing unit #3 rotates and drives the plate cylinder 11, and prints an electronic circuit pattern and a register mark on the printing paper at a location designated from the reference register mark by using a blanket cylinder. The fourth printing unit #4 rotates and drives the plate cylinder 11, and prints an electronic circuit pattern and a register mark on the printing paper at a location designated from the reference register mark by using a blanket cylinder. In this case, the register marks printed by the third and fourth printing units #3 and #4 can be printed at an accurate location by recognizing a mutual distance m from the reference register mark with a camera and regulating an error calculated, determined and measured by a display to regulate a minute location and a rotation angle through the servo motor 12 and the encoder 13.

In the case of a register mark printed on the printing paper by adjusting a minute location (the register mark printed by the first and second printing units #1 and #2 or by the third and fourth printing units #3 and #4), the electronic printing pattern can be printed at an accurate location in the electronic printing pattern of the first printing unit #1 (this will be also applied in the same way to adjustment of a distance of the register mark printed by the third and fourth printing units #3 and #4). Further, in the case of the register mark printed on the upper and lower sides (the register mark printed by the first and third printing units #1 and #3 or by the second and fourth printing units #2 and #4), a mutual distance m is regulated by controlling rotations and driving of the servo motor 12 and the encoder 13, so that the electronic printing pattern of the third printing unit #3 may be printed at an accurate location on the electronic printing pattern of the second printing unit #2. (This will also be applied in the same way to regulation of the register mark printed by the first and fourth printing units #1 and #4)

Further, the servo motor 18 and the encoder installed at an opposite end of the plate cylinder 11 constituting the printing unit 100 is connected to the driving part 50, and the electronic circuit pattern and the reference register mark are accurately printed on the printing paper by minutely adjusting a location of the plate cylinder 11 in the left and right direction (axial direction) through the servo motor 18. The register mark printed by the first printing unit #1 becomes a reference register mark, and in the case of the register mark printed on the left and right sides thereof (the register mark printed by the second printing unit #2 or the third and fourth printing units #3 and #4), the electronic printing pattern of the first printing unit #1 and the electronic printing pattern of the second printing unit #2 may be printed at an accurate location by regulating a mutual distance l, and is applied in the same way to regulation of a distance between the register marks printed by the third and fourth printing units #3 and #4.

In this case, in the case of the printing unit 100 which has printed the register mark while the deviation is generated due to a location of the register mark previously designated by the user by the driving part 50 having received a correction signal of the vision control system 30, a location of the plate cylinder 11 of the printing unit 100 is minutely adjusted several times in a rotation direction or axial direction in one rotation thereof through the servo motors 12 and 18.

That is, while a printing interval (D1, the printing intervals consequently means a predetermined interval between the register marks) of the plurality of register marks printed on the printing paper 1 is allowed, the vision control system 30 calculates a location deviation of the register marks photographed by the camera devices 20 of the printing units 100 before the next register mark is read to transmit a correction signal to the driving part 50 to adjust the location of the plate cylinder 11.

The display device 40 receives the register mark photographing screen 3 of the corresponding printing unit 100 photographed by the camera device 20 from the vision control system 30 so that the user can easily identify the register mark photographing screen 3, and as illustrated in FIG. 2, it can be seen whether the electronic circuit pattern which is being printed is printed or aligned at an accurate location of the printing paper 1 by showing a printing screen where the register mark is displayed according to an exemplary embodiment.

A method of selecting the register marks having the four forms suggested by the present invention and applying and disposing the register marks to different plate cylinders 11 is as illustrated in FIG. 4 as an exemplary embodiment.

As described above, in FIG. 4, the register marks M having the four shapes including '⌐', '¯', '⌟', and '⌙' are applied to the plate cylinders 11 of the four printing units 100 and one of the methods of disposing the register marks is illustrated. In an 'A' row of FIG. 4, the number of the corresponding printing unit (the first printing unit is denoted by #1, the second printing unit is denoted by #2, the third printing unit is denoted by #3, and the fourth printing unit is denoted by #4) and the corresponding register mark (the register mark of the first printing unit is '⌐', the register mark of the second printing unit is '¯', the register mark of the third printing unit is '⌟', and the register mark of the fourth printing unit is '⌙') are illustrated, and in a 'B' row of FIG. 4, a printing result of the register mark normally photographed through the camera device 20 mounted to the corresponding printing unit 100 is exemplified. That is, the printing result of the 'B' row of FIG. 4 is a result printed together with the register marks photographed while reaching the corresponding printing unit 100, and in the case of the third printing unit #3, the register mark itself is '⌟' but as it has gone through the first and second printing units #1 and #2 before passing through the third printing unit #3, a total of three register marks having different shapes including a '⌟' shape which is the register mark of its own together with the register marks having '⌐' and '¯' shapes are printed after the printing paper 1 has passed through the third printing unit #3.

Further, although an embodiment of performing precision overprinting four times through the four printing units having different register mark shapes through the exemplary embodiment of the present invention, when precision overprinting is performed more than four times, the number of printing units may be increased such that more than four printing units having different register mark shapes may be used.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

| <Description of symbols> | |
|---|---|
| 1: Printing paper | 2: White margin |
| 10: Printing device | 11: Plate cylinder |
| 12, 15, 18, 26: Servo motor | 13, 16, 27: Encoder |
| 14: Blanket cylinder | 17: Pressing cylinder |
| 20: Camera device | 21: Camera sensor |
| 22: Camera lens | 23: Lamp |
| 25: Camera driving device | 28: LM guide |
| 30: Vision control system | 40: Display device |
| 50: Driving part | 60: Central console |
| 100: Printing unit | |
| D1: Predetermined interval | M: Register mark |
| P: Electronic circuit pattern | S: Reference location coordinate |
| α: Reference register mark | |

What is claimed is:

1. A precision overprinting method of printed electronics rotary printing in which a location can be adjusted in real time, for overprinting an electronic circuit pattern (P) by using a roll-to-roll rotary printing system including a plurality of gravure offset printing units (100), comprising:

a mark displaying step (S100) of printing register marks (M) on a printing paper (1) through printing devices (10) of the printing units (100), and printing the register marks (M) having different shapes with the printing units (100), respectively;

a mark photographing step (S200) of photographing the register marks (M) printed on the printing paper (1) by the printing units (100) through a camera device (20);

a mark location measuring step (S300) of receiving register mark (M) image information of the camera device (20) through a vision control system (30) to verify the register mark image information with a display device (40), and comparing a location coordinate of a photographed register mark (M) with the location coordinate previously designated by a user to calculate a deviation; and an overprinting correcting step (S400) of receiving a correction signal from the vision control system (30), and adjusting a location of a plate cylinder (11) of a corresponding printing unit (100) where the deviation of a register mark (M) is generated to align the overprinting of the electronic circuit pattern, wherein the register marks (M) printed through the plurality of printing units (100) have different shapes to be easily identified from each other, the plurality of gravure offset printing units (100) includes a first printing unit #1, a second printing unit #2, a third printing unit #3 and a fourth printing unit #4, and the register marks comprise a first register mark having a '⌐' shape engraved in the plate cylinder of the first printing unit #1, a second register mark having a '¬' shape engraved in the plate cylinder of the second printing unit #2, a third register mark having a '⌋' shape engraved in the plate cylinder of the third printing unit #3, and a fourth register mark having a '⌊' shape engraved in the plate cylinder of the fourth printing unit #4, such that the register marks engaged in the printing units may be printed whenever the printing paper passes through the first printing unit #1, the second printing unit #2, the third printing unit #3 and the fourth printing unit #4, and wherein the mark displaying step (S100) is performed by a gravure offset printing device (100) including:

a plate cylinder (11) where a set of register marks (M) having the same shape are spaced apart from each other at a predetermined interval (D) at a circumference of an outer peripheral surface of an end thereof;

a blanket cylinder (14) to which the electronic circuit pattern (P) and the register mark (M) of the plate cylinder (11) is printed and transferred as the blanket cylinder (14) is rotated at the same printing speed as that of the plate cylinder (11) while contacting the plate cylinder (11); and a pressing cylinder (17) configured to print and transfer the electronic circuit pattern (P) and the register mark (M) to the printing paper (1) as the pressing cylinder (17) is rotated while contacting the blanket cylinder (14) via the printing paper (1), wherein a first servo motor (12) and an a first encoder (13) installed at one side of the plate cylinder (11) regulate a rotation angle of the plate cylinder (11) according to a location signal of the vision control system (30) and minutely adjust a printing location in the rotation direction to minutely adjust the locations of the set of register marks of the plate cylinder (11) forward and rearward, a second servo motor (18) installed at an opposite side of the plate cylinder (11) quickly minutely adjusts a location of the plate cylinder (11) in an axial direction according to a location signal of the vision control system (30) to minutely adjust the locations of the set of register marks of the plate cylinder (11) in an axial direction, and a third servo motor (15) and a second encoder (16) driven under the control of a synchronous electronic gear are installed at one end of the blanket cylinder (14) to rotate the blanket cylinder (14) at the same speed as that of the plate cylinder (11) and minutely adjust a printing location in the rotation direction to minutely adjust the locations of the set of register marks of the blanket cylinder (14) forward and rearward, wherein: one register mark in the set of register marks (M) formed in the plate cylinder (11) of the first printing unit #1 of the plurality of printing units (100) becomes a reference register mark (a) of remaining printing units (100), remaining register marks (M) of the remaining printing units (100) are spaced apart in a transverse or longitudinal direction of the reference register mark (a) in the printing paper (1) to be printed, and the register marks (M) of the plurality of printing units (100) are printed at predetermined locations where the register marks (M) of the plurality of printing units (100) are against each other not to overlap each other, wherein: when a mutual location between the reference register mark (a) of the first printing unit #1 and the remaining register marks (M) of the remaining printing units (100) is determined, while taking center points of imaginary lines connecting opposite ends of at least two of the register marks as reference location coordinates (S), an error of a mutual distance (l, m) between the reference location coordinates (S) is calculated to correct a location of the plate cylinder (11).

2. The precision overprinting method of claim 1, wherein:

the location of the plate cylinder (11) is adjusted a plurality of times in a rotation direction or an axial direction in one rotation toward the blanket cylinder (14) rotating while contacting the plate cylinder (11), by a driving part (50) having received the correction signal of the vision control system (30).

3. The precision overprinting method of claim 1, wherein:

the predetermined interval (D)

is an interval at which the register marks (M) are spaced apart from each other such that the register marks (M) at the front and rear ends which are adjacent to a photographing screen (3) of the cameral device (20) are not simultaneously photographed when the register marks are photographed.

4. The precision overprinting method of claim 1, wherein:

the vision control system (30)

calculates a location deviation of the register mark (M) photographed by the camera device (20) of the printing units (100) before a next register mark (M) is read and adjusts a location of the plate cylinder (11) while a printing interval (D) of the plurality of register marks printed on the printing paper (1) is allowed.

5. The precision overprinting method of claim 1, wherein:

the camera device (20)

is a still image device capable of recognizing an image of a micrometer size and displaying a visual quality of the printing image with the display device (40), and includes:

a high precision CCD or CMOS area camera sensor (21);

a camera lens (22) configured to compensate a pixel size of the camera sensor (21) to obtain a precise image; and a lamp (23) configured to provide a light amount for a clear image.

* * * * *